US006881155B2

(12) United States Patent
Rohan-Weaver

(10) Patent No.: US 6,881,155 B2
(45) Date of Patent: Apr. 19, 2005

(54) DYNAMIC GOLF SWING TRAINER ASSURING PROPER WRIST AND CLUB FACE POSITIONS

(75) Inventor: John W. Rohan-Weaver, Clermont, FL (US)

(73) Assignee: Julian C. Renfro, Winter Park, FL (US); part interest ( * ) Notice: Subject to any disclaimer, the term of this patent is extended or adjusted under 35 U.S.C. 154(b) by 0 days.

(21) Appl. No.: 10/724,387

(22) Filed: Dec. 1, 2003

(65) Prior Publication Data

US 2004/0198526 A1 Oct. 7, 2004

Related U.S. Application Data

(63) Continuation-in-part of application No. 29/190,837, filed on Sep. 29, 2003, now Pat. No. Des. 493,503, and a continuation-in-part of application No. 10/408,041, filed on Apr. 7, 2003, now Pat. No. 6,800,036.

(51) Int. Cl.[7] ..... A63B 69/36
(52) U.S. Cl. ..... 473/219; 473/226; 473/276
(58) Field of Search ..... 473/206, 212, 473/213, 219, 223, 226, 227, 257, 266, 276

(56) References Cited

U.S. PATENT DOCUMENTS

| | | | | | |
|---|---|---|---|---|---|
| 3,874,668 | A | * | 4/1975 | Flege | 473/227 |
| 5,009,426 | A | * | 4/1991 | Cox | 473/227 |
| 5,127,650 | A | * | 7/1992 | Schneller | 473/204 |
| 5,294,126 | A | * | 3/1994 | Armstrong, III | 473/227 |
| 5,851,156 | A | * | 12/1998 | Schwark, Jr. | 473/201 |
| 6,283,874 | B1 | * | 9/2001 | Studebaker | 473/227 |
| 6,558,302 | B1 | * | 5/2003 | Cluff | 482/129 |

* cited by examiner

*Primary Examiner*—Gregory Vidovich
*Assistant Examiner*—Nini F. Legesse
(74) *Attorney, Agent, or Firm*—Julian C. Renfro, Esq.

(57) ABSTRACT

A dynamic golf swing trainer assuring proper wrist and club face positions throughout the swing of a golf club, with this trainer being intended to teach full swing positioning to a golfer. This trainer is constructed of rigid material and configured to have a shaft with a handle portion adapted to be grasped by the golfer so that the golfer can swing the trainer in the general manner of a golf club. The club shaft extends past the handle portion in a direction away from the club head and forms a generally U-shaped portion. This latter portion is disposed at an angle to the shaft, so that when the golfer is grasping the handle portion, a part of the U-shaped portion may rest against the leading forearm of the golfer, or directly above the leading forearm, thus to assure proper wrist action, and proper club face presentation.

19 Claims, 5 Drawing Sheets

FIG 5
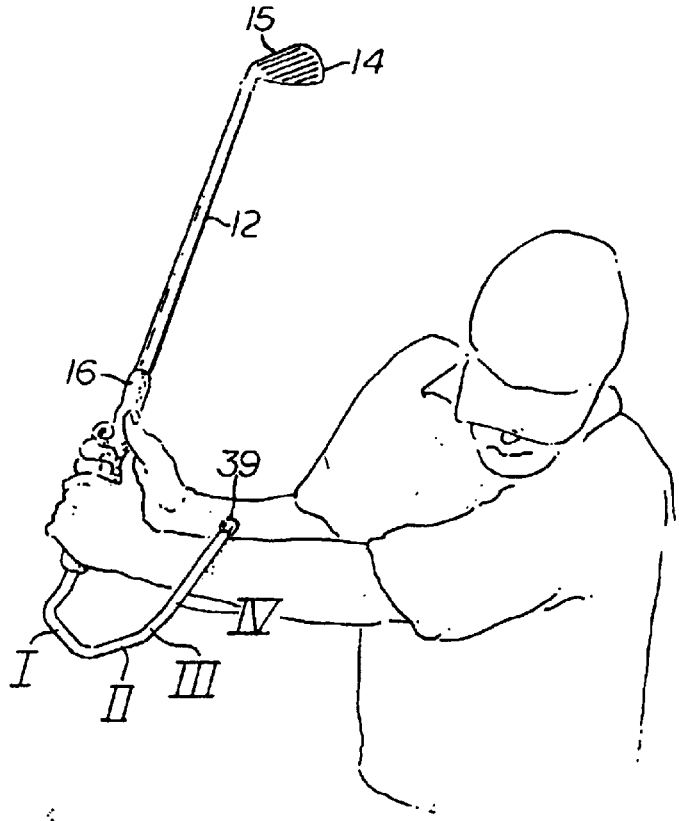
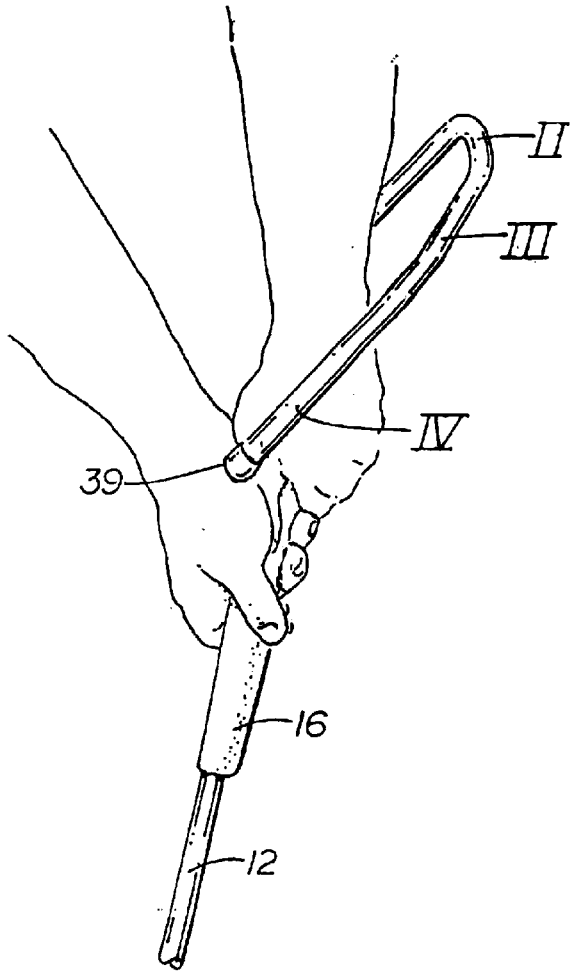
FIG 6

DYNAMIC GOLF SWING TRAINER ASSURING PROPER WRIST AND CLUB FACE POSITIONS

RELATIONSHIP TO PRIOR INVENTION

This invention bears a distinct relationship to my Continuation-in-Part application "Golf Swing Position Trainer Teaching a Golfer to Swing a Golf Club Correctly," Ser. No. 10/408,041, filed Apr. 7, 2003, now U.S. Pat. No. 6,800,036. The instant application is a Continuation-in-Part of my design case entitled "Dynamic Golf Swing Trainer," Ser. No. 29/190,837, filed Sep. 29, 2003, now U.S. Pat. No. D493,503. The teachings of both of these inventions and the respective patent applications are hereby incorporated by reference into the instant case.

BACKGROUND OF THE INVENTION

In the past, a number of devices have been proposed for use by golfers, to aid them in developing and improving their swings. Unfortunately, many of the prior art devices concerned with the swing of the club have been expensive to purchase and/or difficult to use. As a consequence, only a very few of these training devices have gained favor with golfers.

It would be ideal to provide a device to assist a golfer in achieving the correct club face rotation throughout the backswing and through-swing; in achieving proper hinging and release of the golf club during the back swing and through-swing; in assuring proper positioning of both of the golfer's hands when he is at the top of his back swing of the club; and at the initiation of his down swing of the golf club as well as at the through swing and the end of the follow-through swing. By achieving proper rotation and hinge of the club as well as the correct hand positions, the golf club would ideally stay on its proper swing plane, thereby enabling the golfer to achieve a well-executed shot.

Certain prior art devices caused the wrist to be held in a flat or bowed position through the entire swing, which was somewhat helpful, but this did not allow for achieving a square club face at the time of impact with the ball. In other words, the holding of the wrist in the flat position does not guarantee that the club face will be square in order that erratic ball flight can be avoided. Stating this differently, the known prior art devices designed to assure a flat left wrist, desirable at the time of impact, utterly fail to permit the wrist to be bent at setup and at finish. Because the bent wrist was not permitted at these times, off-plane movement of the club resulted.

A more desirable apparatus would not need to be rigidly attached to the golfer's wrists, hands or arms, as many prior golf training devices have required. Moreover, a desirable apparatus would be useful for training golfers in the full swing of a club, rather than being limited to training a golfer to putt, or chip which is the case with many prior golf training devices.

Regarding some of the relevant prior art, U.S. Pat. No. 2,273,416 to Norwood describes a golf instruction device which includes a harness that is attached to a golfer's right wrist (for a golfer with a right-handed swing) and a rigid guide which contacts the top of the club above the hands. The Norwood device does not address positioning of both hands and arms, nor is it directed to correction of the swing. Rather, it is designed to train a golfer in correcting his putting and the shorter approach shots.

U.S. Pat. No. 3,951,416 to Koch describes a golf training device which includes a clamp at the top of the golf club and a clamp that attaches to the wrist of the golfer's trailing arm. That training device is designed to improve the golfer's short swings and putting, but is not applicable to training for full swings. Moreover, the device restricts the golfer to using a "choked-up" grip because one of the clamps is positioned at the top of the club.

Another of the pertinent prior art patents is the Lorang U.S. Pat. No. 4,023,812 entitled "Golf Swing Wrist Action Training Apparatus," in which the patentee is concerned with the difficulty of teaching the super-imposition of the wrist swing on the arm swing together with all the other do's and don'ts of golf instruction. This patentee provides a leg attached to the shaft of a golf club at a point below where the player's hands engage the grip portion of the shaft, with this leg being mounted on the off-target side of the shaft. The player is to keep his wrists straight during the initial portion of the backswing, but when his hands are approximately at the level of his hips, the player cocks his wrists in the off-target direction and this swings the shaft in an appropriate manner, with this swing of the shaft relative to the off-target forearm also swinging this leg. In accordance with the Lorang invention, signal means are provided for advising the player when he has properly cocked his wrists, when he has properly uncocked his wrists, and also when he relaxes his wrists and let them uncock inadvertently. To this end, the patentee has provided a sound signal "clicker" device actuated at the contact end of the leg, which emits a "click" signal upon a full wrist cock.

Obviously it is not only expensive but also burdensome for all of these ancillary components to be added to a golf club used for practice.

Somewhat along the lines of the Lorang patent is the Stewart U.S. Pat. No. 4,145,054 entitled "Golf Swing Training Aid." Stewart provides a laterally-spaced, angularly-directed bifurcation of the shaft of his golf club. This patentee mentions that during a properly executed swing, this added component, spoken of as a long, slim rod, remains inoperative during a properly executed swing. However, the patentee continues on to state that this rod contacts the forearms of the golfer during an improperly executed swing, thus advising him of his error. Like Lorang, the slim rod added to the club shaft by Stewart is burdensome, and adds unnecessary weight to the golf club-like device.

The Richards U.S. Pat. No. 4,381,111 entitled "Golf Swing Simulator Device" is an elaborate device that would be expensive to produce and difficult to use. This patent would solve few of the problems with golf swing that are solved by the use of the instant invention.

The Cox U.S. Pat. No. 5,009,426 entitled "Golf Club Guide Means" provides an attachment to the upper end of the club shaft, and provides an abutment which continuously engages the user's trailing forearm during both the backswing and the follow-through positions. This is done, in accordance with the Cox patent, in order to maintain operative alignment between the club and the user's trailing arm as the club is swung through each position. Unfortunately, the Cox device has only limited pertinence insofar as teaching proper wrist action and proper forearm rotation, as will be helpful to a novice golfer striving to improve his stroke.

U.S. Pat. No. 5,203,568 to Vasquez discloses a device which is designed to train golfers in putting. It does not address a full swing. Similarly, U.S. Pat. No. 5,320,354 to Vasquez discloses a device to train golfers in pitching and putting and likewise does not address a full swing.

U.S. Pat. No. 5,248,146 to Viets et al discloses a device which attaches to the top of the golf club and includes two rigid clamps for each arm. Once again, this patent is concerned only with arm positioning for putting and does not address full swing positioning.

The Armstrong, III U.S. Pat. No. 5,294,126 entitled "Golf Swing Aid" is quite burdensome to use, has only very limited applicability to the invention at hand, and does not purport to improve upon the wrist action of the golfer.

U.S. Pat. No. 5,667,447 to Perham et al relates to a movement-sensing device which is attached to a golfer's leading arm and extends between the forearm to midway up the biceps, encasing the elbow. The device includes electronic sensors which alert the golfer when the leading arm is not properly positioned. The device is directed solely to the proper positioning of the leading arm. It obviously would be too expensive to be purchased by many golfers.

It was in an effort to overcome the shortcomings of these and other such patents that the instant invention was created.

SUMMARY OF THE INVENTION

One of the principal features of my invention involves the fact that my novel dynamic golf swing trainer permits the left wrist of a right-handed golfer to be bent somewhat at the time of setup; to be flat at the top of the backswing, all the way through to the follow-through position, yet allowing the wrist to go back into the desirably bent condition at the finish. These various optimum movements of the wrist during the swing of the golf club are brought about by the utilization, in accordance with this invention, of a novel upward extension of the club shaft. This upward extension involves an upstanding curved portion, preferably a generally U-shaped member. The U-shaped member is substantially contained in a plane residing at an acute angle to the centerline of the club shaft. The generally U-shaped member may have four sections, located generally in a common plane but not precisely so, with one or another of these four sections being brought successively into contact with the leading forearm, which of course is the left forearm of a right-handed golfer, at entirely different times during the swing of the club. As a result of this highly advantageous construction, a square club face as well as proper forearm rotation are maintained from the setup or address position all the way through to the finish of the swing.

It is therefore a goal of the present invention to provide an apparatus of non-complex construction featuring full swing positioning, usable in training a golfer in achieving correct club face rotation throughout the back swing and through-swing, without it being necessary to affix a cumbersome, training-type device between the club head and the handle portion of the club shaft.

It is another goal of my invention to provide a golf training device involving a club whose shaft extends beyond the handle to form a generally U-shaped portion intended to slide along the leading forearm of the golfer during the swing of the club, assuring proper wrist position at all phases of the swing and bringing about proper club face rotation.

My presently pending patent application entitled "GOLF SWING POSITION TRAINER TEACHING A GOLFER TO SWING A GOLF CLUB CORRECTLY," Ser. No. 10/408,041, was filed Apr. 7, 2003. That application has now ripened into U.S. Pat. No. 6,800,036, with that invention having been commercially successful in that it taught proper club shaft plane, along with proper radius between the left wrist and the chest of a right-handed golfer. However, my previous invention did not serve to assure a square club face and proper forearm rotation from the setup all the way to the finish. The relevant teachings of that invention are hereby incorporated by reference into this case.

One of the features distinguishing the instant invention involves the fact that this device advantageously permits the left (forward) wrist of the right-handed golfer to be bent at the time of setup, while then becoming flat at the top of the backswing, with the flat wrist continuing through the follow-through position, with the wrist advantageously being permitted to go back into the bent condition at the finish.

In designing the instant golf swing position trainer, I was mindful of the fact that many golfers tend to develop golf swings that are inconsistent with the ball being hit squarely, and having it travel in the expected direction. To this end the present device has been designed to teach the fundamentals of the golf swing to a golfer, without this novel device being intended to actually strike a golf ball. My dynamic golf swing trainer is advantageously configured to in effect force the golfer to maintain his or her hands, arms, shoulders and hips in a desirable and effective relationship during the entire swing of a golf club.

My novel device is manifestly intended for use by males as well as females, and for left handed golfers as well as right-handed golfers, but for the purpose of simplifying the description, I intend, when using the personal pronouns his or him, to include the fact that the golfer may be female, where the pronouns hers or her would normally apply. Also, it will later be seen that I have illustrated my novel device in use by a right-handed golfer inasmuch as something more than 85% of the world's population is understood to be right handed. Quite obviously, my device will manifestly be marketed for left handed as well as right-handed golfers, and the descriptive portions appearing herein that specifically mention right-handed golfers are clearly not intended to preclude the use of a suitably configured version of my invention by a left-handed golfer.

The golf swing position trainer I have developed is preferably constructed of a single piece of stiff material, that has been configured into a compound curvature designed to provide appropriate leading forearm contact as will enable the golfer to achieve the correct golf swing position movement and ultimately improve his golf swing.

It is thus to be seen that I have provided a readily transportable position trainer device utilizing no burdensome attachments to the shaft between the club head and the handle portion of a golf club, that is effective in causing the golfer to maintain the handle portion in the appropriate relationship to his or her upper body throughout the swing of the club, with no contact of the trainer device with a golf ball being involved.

As will be seen hereinafter in greater detail, the highly advantageous upper extension of the club shaft involves a generally U-shaped member that may be divided into four sections, with one or another of these sections being brought successively into desirable contact with the left forearm of the right-handed golfer during the swinging of the club, in order to assure proper positioning of the wrist at each phase of the swing.

It is therefore a principal object of this invention to provide a golf swing position trainer that is uncomplicated, affordable, easy to utilize, and highly effective in helping a beginning or intermediate golfer develop a highly effective swing.

It is a more specific object to provide a golf swing training apparatus teaching proper wrist positions as well as correct forearm rotation to a golfer.

It is another object of this invention to provide a golf swing position trainer having no attachments to the principal shaft of a golf club, and that is advantageously configured to cause a golfer to achieve the correct club face rotation throughout the back swing as well as during the through-swing.

It is yet another object of this invention to provide a golf swing position trainer effectively teaching full swing positioning, that can readily be manufactured for use either by a left-handed or a right-handed golfer.

These and other objects, features and advantages will become more apparent as the description proceeds.

BRIEF DESCRIPTION OF DRAWINGS

FIG. 5 is a view with particular regard to the relationship of the upper portion of my novel device to the golfer's leading forearm when the club is nearing the top of the backswing, when the section of the generally U-shaped member farthest from the handle is in contact with the forearm of the golfer;

FIG. 6 is a view of my training device with particular regard to the relationship of the upper portion of my novel device to the golfer's leading forearm when the ball would have been struck by the face of the club head.

DETAILED DESCRIPTION

Figure 1:
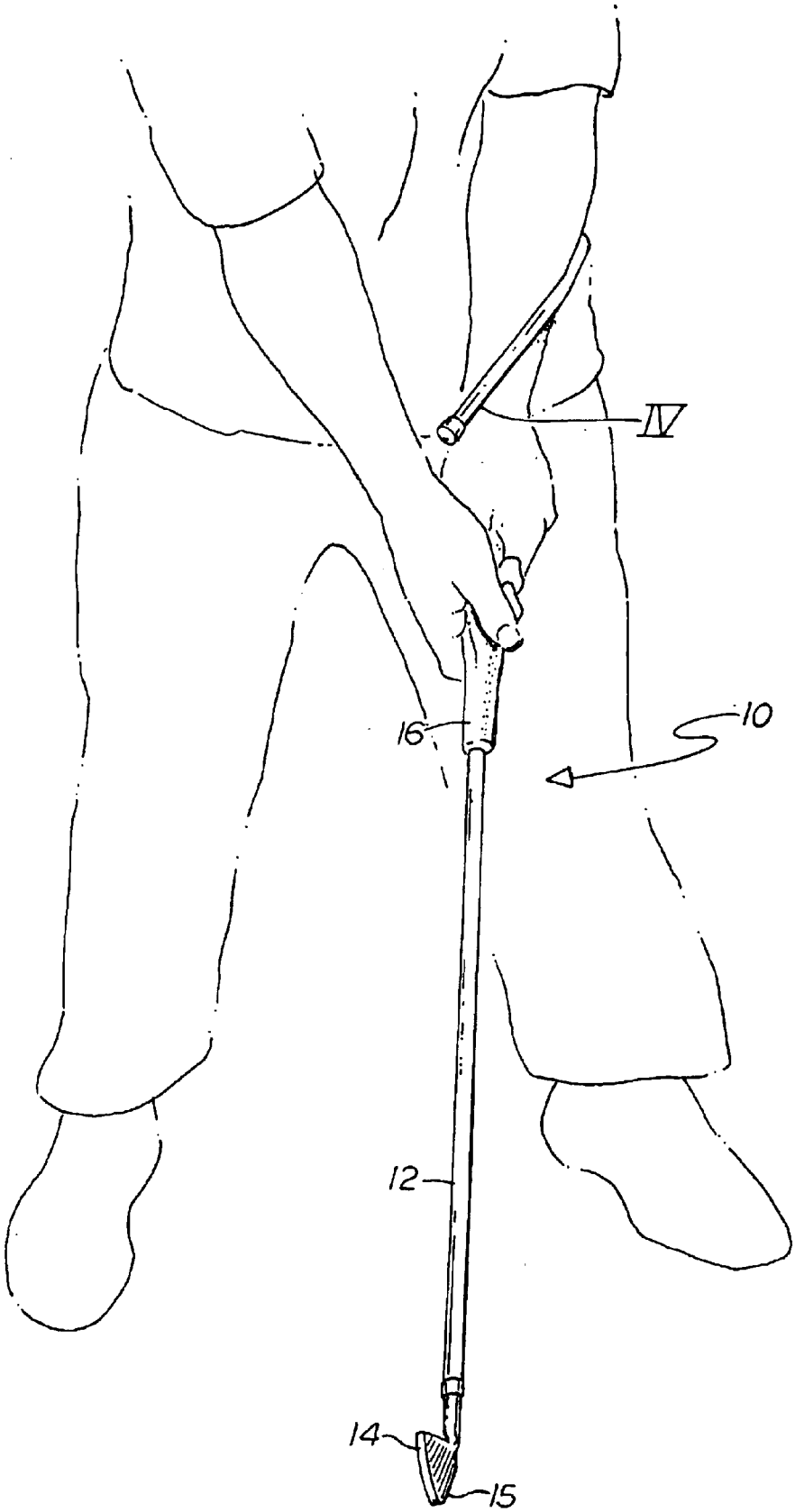
FIG. 1 is a view of my novel dynamic golf swing trainer, as it is being held by a golfer at the time of addressing the ball.

In accordance with this invention I have provided a dynamic golf swing trainer for teaching a golfer to swing a golf club correctly, while maintaining his wrists in the optimum position throughout the swing. An exemplary version of my invention is illustrated in FIG. 1, where my novel golf club trainer 10 has been placed in the address position by a right-handed golfer. As easily seen in this figure as well as in FIG. 2, my dynamic golf swing trainer 10 preferably involves a shaft 12 constructed essentially of a single piece of rigid material. Upon one end of shaft 12, a club head 14 is mounted, with it to be understood that the club head is provided for visual and feel references, and is not actually intended to strike a golf ball.

By way of example, for the shaft 12 I prefer to use an aluminum rod of 6063 aluminum that is ½" in diameter, but I obviously am not to be limited to this. As an alternative, an industrial grade, rigid plastic could in some instances be used when cost is a factor.

A handle portion 16 is affixed to the shaft a spaced distance away from the club head 14, with the handle portion adapted to be grasped by the golfer with both hands, as will be noted in FIG. 1. The handle portion 16 is typically molded of non-metallic material, such as industrial grade plastic. The handle portion preferably is configured to comfortably receive the hands of the golfer in a desirable orientation with respect to the club head, with this arrangement making it readily possible for the golfer to swing the trainer 10 in the general manner of a golf club. However, it is not intended, in the usual practice while using my invention, to actually strike a golf ball with the club head 14. It is to be understood that the portion of the shaft 12 between the club head 14 and the handle portion 16 is essentially straight.

As more clearly shown in FIG. 2, the shaft 12 extends beyond the handle portion 16 to form an upstanding curved portion, preferably a generally U-shaped upper portion 20, described hereinafter in additional detail. Several distant sections preferably constitute the generally U-shaped portion 20, which sections have been designated Section I through Section IV. These four sections are approximately located in a common plane, but not precisely so.

It is apparent from certain figures, such as FIG. 7, that the plane of the generally U-shaped portion 20 does not reside in the plane of the shaft 12, but rather the outer end portion IV of the U-shaped portion 20 is intended to extend as shown in FIG. 1, across the left forearm of the right-handed golfer, for a reason set forth at greater length hereinafter. The preferable angle the outermost section of the generally U-shaped portion bears to the shaft 12 is discussed hereinafter in connection with FIG. 7.

Figure 2:
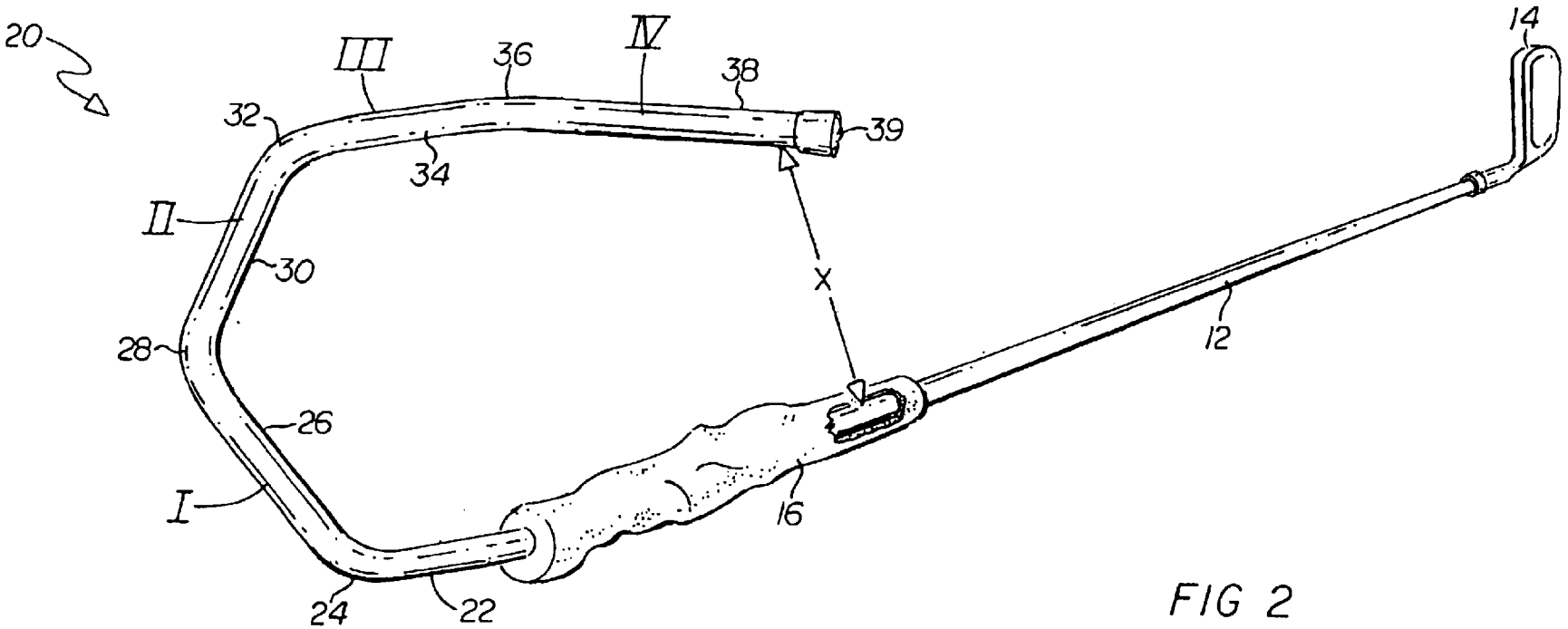
FIG. 2 is a close up view of the upper, U-shaped portion of my dynamic golf swing trainer, which reveals that a substantially 180° bend is formed, with this figure also revealing the various sections that are successively brought into contact with the left forearm of a right-handed golfer during the swinging of the club, thus to assure proper wrist position at each phase of the swing.

Continuing now with primary reference to FIG. 2, it will be noted that the shaft 12 extending past the handle 16 in a direction away from the club head 14 forms the previously-mentioned upstanding curved portion, typically a generally U-shaped portion 20. The portion 20 may preferably have several bends, each at a preferred angle, which serve to define the different Sectors or Stations I through IV.

It is important to understand that these various sections or stations of the generally U-shaped member 20 cause my novel device to be quite distinct in assuring proper wrist positions on the part of the golfer through all phases of the golf swing. It is possible, however, for a usable embodiment of the instant invention to involve a generally U-shaped member possessing a relatively smoothly curved configuration, without the distinct localized bends clearly visible in FIG. 2. Nevertheless, I have found that illustrating an embodiment involving the several bends depicted in FIG. 2 and in certain other figures of drawing is helpful in explaining the specific functions the several sectors or stations serve while assisting a golfer to develop a highly desirable swing.

As will be more fully understood as the description proceeds, my device 10, with its novel upper generally U-shaped extension 20, serves the very important purpose of controlling the positioning of the leading wrist, which is the left wrist in the case of a right-handed golfer, throughout the entire swing of the club. As a consequence of this, the right wrist as well as both forearms contribute properly to a desirable golf swing, wherein a square club face is maintained at the point of impact with the golf ball. It is important to understand that a properly and appropriately configured version of my novel device serves, in the case of the left-handed golfer, to control the positioning of the right wrist of such golfer throughout the entire swing of the club.

It will be noted in FIG. 2 that a short portion 22 of the club shaft 12 extends beyond the handle portion 16, with this short portion or member being in contact with a first bend 24 of the generally U-shaped member 20. This particular construction is of significance in teaching the proper placement of the golfer's hand at the top of the grip. The first bend 24 assures that the top grip goes under the heel pad of the hand, and also permits proper positioning of the index finger.

First bend 24 is in direct contact with part 26 of the U-shaped member, which part will hereinafter be referred to as Section I. With the centerline of portion 22 as a reference, bend 24 is created at an angle between 50° and 60°, preferably at an angle of 55° such that the centerline of part 26 preferably resides at a 55° angle to the centerline of part 22. It is to be noted that Section I may be in contact with the left forearm of a right-handed golfer only when the club is in the follow-through position.

With continuing reference to FIG. 2, the bend 28 adjacent Section I is created at an angle between 60° and 70°, preferably at an angle of 65°, with this leading into a part 30 of the U-shaped member, hereinafter referred to as Section II. It is thus to be understood that the centerline of part 30 preferably resides at a 65° angle to the centerline of part 26. As will later be discussed at some length, Section II of the U-shaped member is in contact with the left forearm of a right-handed golfer when the club is being held in the address position.

The third bend, bend 32, is located where Section II joins part 34 of the U-shaped member, which latter part I prefer to call Section III. The bend 32 located between Sections II and III is typically formed at an angle between 55° and 65°, but preferably 60°. It is thus to be understood that the centerline of part 34 preferably resides at a 60° angle to the centerline of part 30.

It is to be noted that Section III of the U-shaped member is in contact with the left forearm of the right-handed golfer when the club is moving up in what is known as the take away position. At this time the wrist is moving toward a flat or neutral position.

A relatively small bend 36 is located between Section III and the part 38 that I call Section IV. Section IV is the section located at the extreme end of the U-shaped member, or in other words, it is the section farthest from the club head 14 measured along the U-shaped member 20 that forms the upper portion of the club shaft. An end cap 39 may be located at the extreme end of Section IV. It is to be noted that an "X" appears in the center of a double-headed arrow representing the distance between the extreme end of Section IV and the centerline of the lower shaft portion 12. It is to be understood that this distance X may be between seven and nine inches, with the distance or spacing preferably being eight inches, but I am not to be limited to this.

Although I prefer to construct my dynamic golf swing trainer of a single piece of material, such as aluminum rod, I am not to be limited to this, for it may be desirable to construct the generally U-shaped upper portion of my trainer separate from the lower shaft portion 12. For example, at a location interior of the designated location for the handle member 16, a joint may be established that involves one of the members, such as the upper end of the lower shaft 12, being drilled to closely receive a narrowed, diminished diameter portion of the U-shaped member. Then, by the use of an appropriate cement, such as two component epoxy, the lower shaft portion 12 and the upper shaft portion 20 can be joined tightly and permanently together with the club head 14 residing in a desirable relationship with the U-shaped member 20. The handle member 16 may be loosely accommodated on the lower shaft portion 12 during the procedure of joining the shaft 12 and the U-shaped member 20 tightly together, after which the handle member 16 is slid to the appropriate location on my dynamic golf swing trainer and tightly secured in the appropriate orientation in that position.

Back to a consideration of the utilization of my trainer, it is to be understood that Section IV is in contact with the left forearm of the right-handed golfer at the top of the backswing when the wrist is in the fully cocked position, which is the position of the wrist in which the thumb is pointing up. It is to be noted that Section IV moves away from the forearm at the end of the transition.

From the follow-through position, Sections II and III slide on the forearm up to Section IV at the finish.

It should now be apparent that the four sections of the U-shaped member are successively in contact with the left forearm of the right-handed golfer at entirely different times during the swing of the club. This of course means that unlike known prior art devices, the golfer's wrist may move between the different positions that are desirable during the swing of a golf club during the times of addressing the ball, the backswing, the ball contact, and the time of follow-through after the ball has been struck.

This is in sharp contrast with previous known devices of this general type, which corrected for only one wrist condition, typically involving the left wrist being kept flat. Unfortunately, such prior art devices failed to accommodate the bent wrist conditions which are manifestly necessary at the time of setup and at the finish, if the club face is to be maintained in the correct attitude.

It is important to understand that the prior art devices intended to control the golfer's wrist positions actually served to hamper the golfer's ability to control the golf club correctly at all positions of the swing. This is to say, the known prior art devices designed to assure a flat left wrist, desirable at the time of impact, utterly failed to permit the wrist to be bent at setup and at finish. Because the bent wrist was not permitted at these times by the prior art devices, off-plane movement frequently resulted.

My present invention advantageously permits the wrist to be slightly cupped (bent back) at the time of address. Then, when moving toward the top of the backswing, the wrist is advantageously forced by Sections III and IV to change into a flat or neutral wrist condition at the top of the swing. Most importantly, the club face is kept square.

Figure 3:
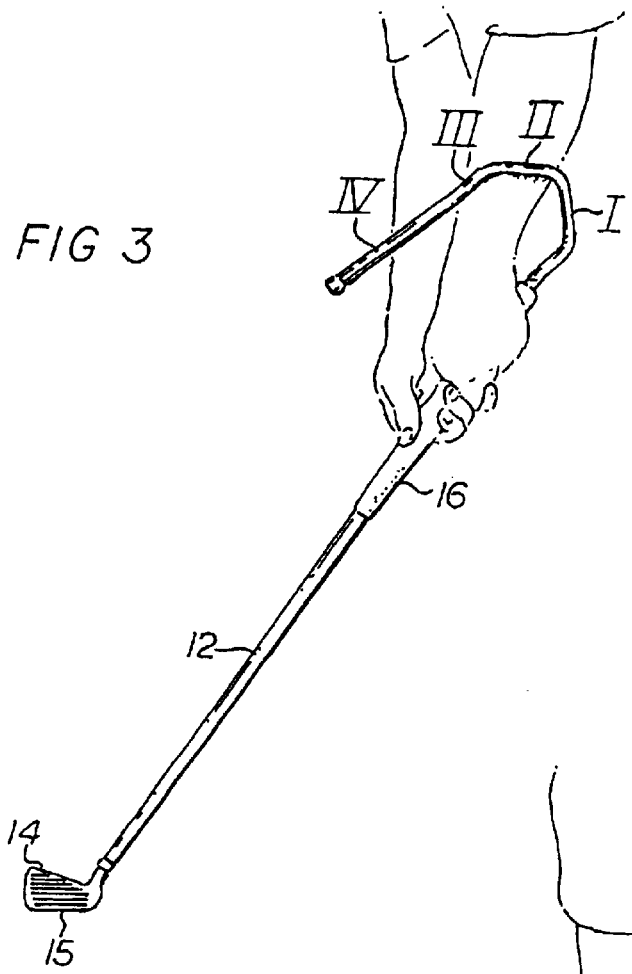
FIG. 3 is a view with particular regard to the relationship of the novel upper portion of my training device to a right-handed golfer's forearm at the time the golfer is holding the device in the address position.

Turning now to FIG. 3, it will be seen in greater detail that when my novel training device is held in the address position, Section II of the U-shaped portion is in contact with the left forearm of the right-handed golfer, with his wrist extended and in the slightly uncocked position, that is, with the knuckles bent slightly down. Visible in this and certain other figures is the leading edge 15 of the club face.

Figure 4:
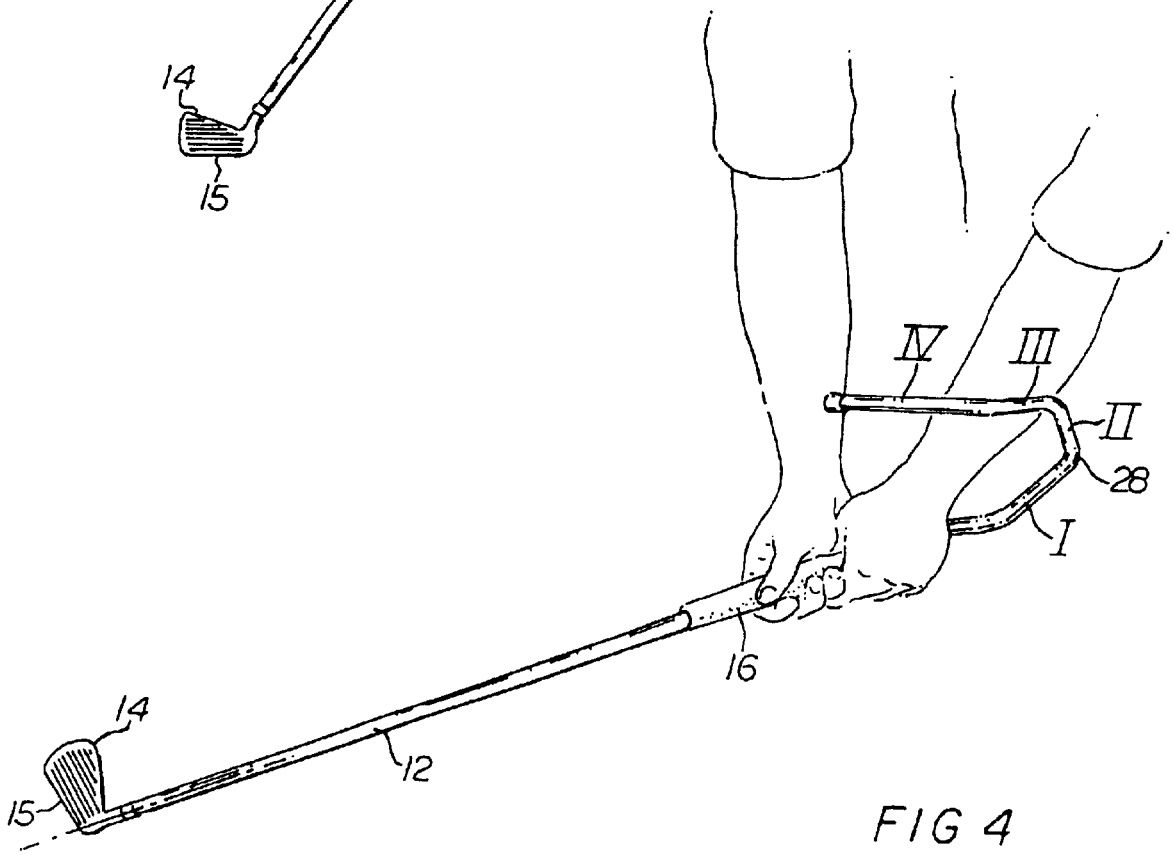
FIG. 4 is a view of my dynamic golf swing trainer with particular regard to the relationship of the novel upper generally U-shaped portion of my training device to the golfer's leading forearm when the golfer is swinging the club upwardly in what is known as the take away position.

FIG. 4 represents the club moving upward in what is known as the take-away position, with Section III having moved into contact with the left forearm of the right-handed golfer, with the wrist in the neutral position. Most importantly, contact of Section III on the leading forearm keeps the hands and club shaft on plane.

With reference to FIG. 5, the golfer has moved my novel training device to a position nearing the top of the backswing, at which time Section IV of the U-shaped member is to be seen in contact with the left forearm of the right-handed golfer. At this time the wrist is fully cocked and flat, and the forearm has been turned on plane. It is to be noted that Section IV, in addition to being in contact with the golfer's forearm at this time, is also in forearm contact in the transition position, when the golf club is moving downwardly.

With reference to FIG. 6, this shows the position of the U-shaped member 20 with respect to the forearm of the golfer at the time the ball is about to be struck. It will be noted that no section of the U-shaped member is in contact with the forearm of the golfer at this time. In accordance with the desired configuration of my novel golf swing trainer, Section IV of the U-shaped member obviously extends at a distinct angle to the lower shaft portion 12.

Figure 7:
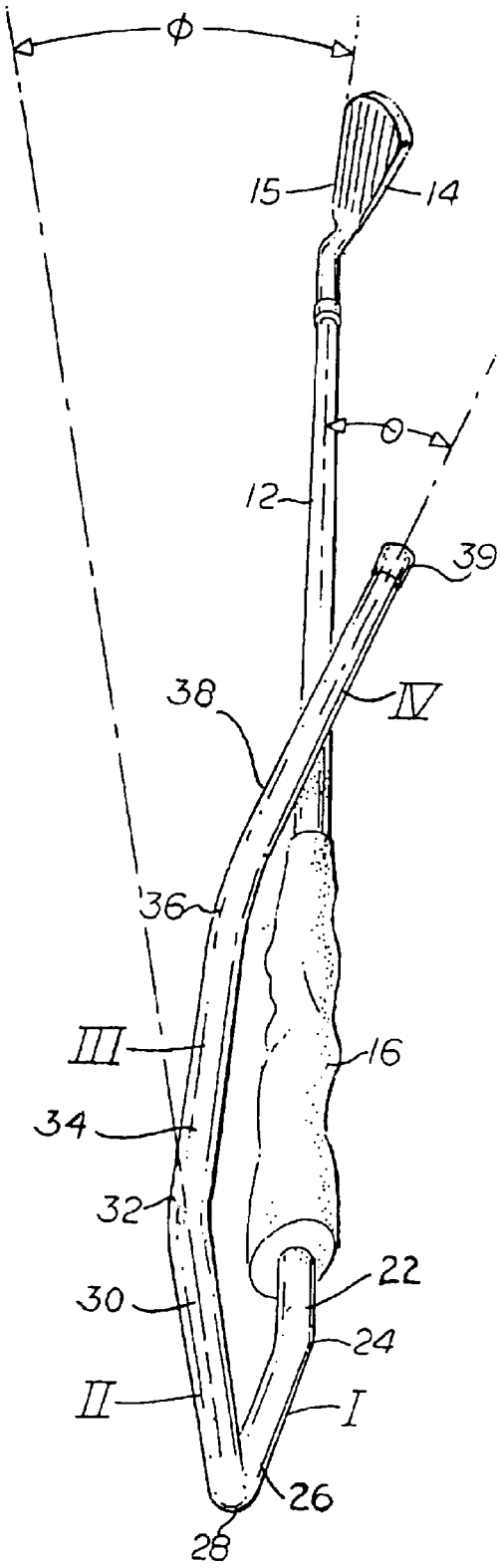
FIG. 7 is a perspective view representing approximately what a golfer might see when looking past the generally U-shaped portion at the club head, with this view revealing the fact that the plane of at least one portion of the generally U-shaped member is disposed in a particular range of angular relationships to the centerline of the club shaft.

With reference now to FIG. 7, it is to be understood that the four Sections I through IV of the U-shaped member 20 reside approximately in a common plane, but not precisely so. I prefer for Sections II and III to be in the same plane, whereas Section IV is bent, as viewed in FIG. 7, slightly to the right of the plane of Sections II and III. For example, Section IV may reside at approximately a 5° angle to the plane of Sections II and III. Quite importantly, Section IV resides at an angle between 15° and 35° with respect to the centerline of the lower shaft portion 12. To be noted is the angle ⊖ appearing in the center of a two-headed arrow, with the preferred angle that Section IV makes with shaft 12 being 25°.

Another important aspect of this invention as depicted in FIG. 7 involves the relationship that Section II of the U-shaped portion bears to the leading edge 15 of the club head 14. By the use of an imaginary line extended through Section II in the general direction of the club head, it is to be understood that this line resides approximately between 15° and 25° with respect to a line extending from the leading edge 15 of the club head 14. This is evident from the angle ∮ appearing in the center of a two-headed arrow residing between the two extended lines, with the preferred angle being 20°.

It will now be apparent that I have designed a golf swing position trainer featuring full swing positioning, that is inexpensive and relatively easy to use, yet enabling positive transfer training, or in other words, my device advantageously makes highly effective motor skill learning readily possible. It is important to recall that my golf swing position trainer is not designed to strike a golf ball. I have found that if a golfer practices with my novel device for approximately ten minutes per day, this will help him (or her) achieve effective motor skill learning of the ideal golf swing.

I claim:

1. A dynamic golf swing trainer assuring proper wrist and club face positions throughout the swing of a golf club, said swing trainer configured to have a shaft, upon one end of which shaft, a club head is mounted, a handle portion affixed to said shaft a spaced distance away from said club head, said handle portion adapted to be grasped by the golfer so that the golfer can swing said swing trainer in the general manner of a golf club, said shaft extending past said handle portion in a direction away from said club head and having an upstanding curved portion, said upstanding curved portion forming a substantially 180° bend, with the outermost end of said upstanding curved portion involving an end member, said end member being spaced away from said shaft, so that when the golfer is grasping said handle portion, a part of said upstanding curved portion may rest against the leading forearm of the golfer, or reside directly above the leading forearm, so that proper wrist action will be assured.

2. The dynamic golf swing trainer assuring proper wrist and club face positions throughout the swing of a golf club as recited in claim 1 in which said upstanding curved portion has several different sectors, with one of said sectors adapted to contact the golfer's leading forearm at one part of the golfer's swing, and another of said sectors contacting the leading forearm at another part of the golfer's swing.

3. The dynamic golf swing trainer assuring proper wrist and club face positions throughout the swing of a golf club as recited in claim 2 in which said upstanding curved portion is made up of four separate sectors.

4. The dynamic golf swing trainer assuring proper wrist and club face positions throughout the swing of a golf club as recited in claim 3 in which said sectors are separated by bends of pre-established angles, created in said upstanding curved portion.

5. The dynamic golf swing trainer assuring proper wrist and club face positions throughout the swing of a golf club as recited in claim 1 in which said end member representing the outermost end of said upstanding curved portion is spaced between seven and nine inches away from said shaft.

6. A dynamic golf swing trainer assuring proper wrist and club face positions throughout the swing of a golf club, said swing trainer configured to have a shaft, upon one end of which, a club head is mounted, a handle portion affixed to said shaft a spaced distance away from said club head, said handle portion adapted to be grasped by the golfer so that the golfer can swing said swing trainer in the general manner of a golf club, said shaft extending past said handle portion in a direction away from said club head and having an upstanding curved portion, said upstanding curved portion being of a generally U-shaped configuration forming a substantially 180° bend, said upstanding curved portion residing in a plane disposed at an angle to the centerline of said shaft, so that when the golfer is grasping said handle portion, a part of said generally U-shaped portion may rest against the leading forearm of the golfer, or directly above the leading forearm, so that proper wrist action will be assured.

7. The dynamic golf swing trainer assuring proper wrist and club face positions throughout the swing of a golf club as recited in claim 6 which said generally U-shaped portion has several different sectors, with one of said sectors adapted to contact the golfer's leading forearm at one part of the golfer's swing, and another of said sectors contacting the leading forearm at another part of the golfer's swing.

8. The dynamic golf swing trainer assuring proper wrist and club face positions throughout the swing of a golf club as recited in claim 7 in which said generally U-shaped portion is made up of four separate sectors.

9. The dynamic golf swing trainer assuring proper wrist and club face positions throughout the swing of a golf club as recited in claim 8 in which said sectors are separated by bends of pre-established angles, created in said generally U-shaped portion.

10. The dynamic golf swing trainer assuring proper wrist and club face positions throughout the swing of a golf club as recited in claim 7 in which said club head has a leading edge, with said leading edge residing at a pre-established angle to one of the sectors of said generally U-shaped member.

11. The dynamic golf swing trainer assuring proper wrist and club face positions throughout the swing of a golf club as recited in claim 6 in which the part of said generally U-shaped portion that is the farthest distance from said handle portion, measured along said U-shaped portion, resides at an angle between approximately 15° and 35° to the centerline of said shaft.

12. The dynamic golf swing trainer assuring proper wrist and club face positions throughout the swing of a golf club as recited in claim 6 in which said upstanding curved portion has an outermost end that is spaced between seven and nine inches away from said shaft.

13. A dynamic golf swing trainer assuring proper wrist and club face positions throughout the swing of a golf club, said swing trainer being configured to have a shaft, upon one end of which shaft, a club head is mounted, a handle portion affixed to said shaft a spaced distance away from said club head, said handle portion adapted to be grasped by the golfer with both hands so that the golfer can swing said swing trainer in the general manner of a golf club, said shaft extending past said handle portion in a direction away from said club head and having a generally U-shaped portion, said generally U-shaped portion being a continuation of said shaft and forming a substantially 180° bend, which generally U-shaped portion is disposed at an angle to the centerline of said shaft, so that when the golfer is grasping said handle portion, a part of said generally U-shaped portion may rest against the leading forearm of the golfer, or reside directly above the leading forearm, such that proper wrist action will be assured.

14. The dynamic golf swing trainer assuring proper wrist and club face positions throughout the swing of a golf club as recited in claim 13, which said generally U-shaped portion serves as a wrist-controlling member, said U-shaped portion having several different sectors, with one of said sectors adapted to contact the leading forearm at one part of the golfer's swing, and another of said sectors adapted to contact the leading forearm during another part of the golfer's swing, so that proper wrist action will be assured.

15. The dynamic golf swing trainer assuring proper wrist and club face positions throughout the swing of a golf club as recited in claim 14 in which generally U-shaped portion is made up of four separate sectors.

16. The dynamic golf swing trainer assuring proper wrist and club face positions throughout the swing of a golf club as recited in claim 13 in which the part of said generally U-shaped portion that is the farthest distance from said handle portion, measured along said U-shaped portion, resides at an angle between approximately 15° and 35° to the centerline of said shaft.

17. The dynamic golf swing trainer assuring proper wrist and club face positions throughout the swing of a golf club as recited in claim 13 in which said shaft as well as said U-shaped portion are formed from a single piece of rigid material.

18. The dynamic golf swing trainer assuring proper wrist and club face positions throughout the swing of a golf club as recited in claim 13 in which said shaft as well as said U-shaped portion are separately formed and subsequently attached tightly together in a permanent manner.

19. The dynamic golf swing trainer assuring proper wrist and club face positions throughout the swing of a golf club as recited in claim 13 in which said upstanding curved portion has an outermost end, which is spaced between seven and nine inches away from said shaft.

* * * * *